US005177466A

United States Patent [19]

Lai

[11] Patent Number: 5,177,466

[45] Date of Patent: Jan. 5, 1993

[54] LOCK STRUCTURE WITH A WARNING DEVICE

[76] Inventor: Chung C. Lai, No. 10 Lane 2, pai whan pu Li Jen, Nan Tou Hsien, Taiwan

[21] Appl. No.: 740,085

[22] Filed: Aug. 5, 1991

[51] Int. Cl.[5] ..... E05B 45/06; H01H 27/06

[52] U.S. Cl. ..... 340/542; 70/358; 70/439; 70/493; 70/DIG. 49; 200/61.66

[58] Field of Search ..... 340/542; 200/61.66, 200/61.76; 70/DIG. 49, 439, 358, 493

[56] References Cited

U.S. PATENT DOCUMENTS 3,587,081 6/1971 Hawkins et al. ..... 340/542 X
4,603,565 8/1986 Strassmeir ..... 70/493 X
4,732,023 3/1988 Shen ..... 70/493 X
4,760,722 8/1988 Fann et al. ..... 70/358
5,041,814 8/1991 Lin ..... 340/542

*Primary Examiner*—Jin F. Ng
*Assistant Examiner*—Thomas J. Mullen, Jr.
*Attorney, Agent, or Firm*—Yuso International Patent and Trademark Office

[57] ABSTRACT

A lock structure with a warning device, in which an additional set of tumblers are installed on the four sides of the cylinder body, the plug member and the sliding sleeves; in case of a wrong key being inserted into the cylinder body, the tumblers will be touched and projected outwards to trigger off a warning device.

4 Claims, 7 Drawing Sheets

LOCK STRUCTURE WITH A WARNING DEVICE

BACKGROUND OF THE INVENTION

Most conventional locks use tumblers to control a lock; in such locks, a plurality of springs and tumblers are installed in and between the cylinder body and the plug member of a lock cylinder; when a correct key is inserted in the lock cylinder, the tumblers will be pushed to a splitting line, after which the plug member can be rotated to unlock the lock.

Such a conventional lock is usually unable to prevent picking by a lock picker. Generally, a lock picker uses a feeling method or a scanning method to pick a lock by lifting all the tumblers one after another or by lifting all the tumblers together, and then rotating the plug member.

SUMMARY OF THE INVENTION

This invention relates to a lock structure with a warning device, which comprises a lock cylinder, a bolt coupling assembly, a warning assembly, a knob, a body portion, a cover plate, and a latch plate. The lock cylinder includes a plug member having two end portions, two sliding sleeves mounted in the cylinder body, and an end cap. The four sides (i.e., upper, lower, left and right sides) of the cylinder body, the plug member, and the sliding sleeves are provided with a plurality of round holes for loading tumblers and springs respectively; all the tumblers and springs are held in place with a plurality of retaining strips. When a correct key is inserted into the lock cylinder, the plug member, and the sliding sleeves are lifted up to a splitting line; in that case, the plug member can be rotated to actuate the bolt coupling assembly, and then the lock is unlocked. In case a wrong key is inserted in the lock cylinder, the plug member would not be rotated; at the same time the special tumblers will be touched to actuate the switch control rod of the warning assembly to spring out. The prime feature of the present invention is that the lock cylinder includes a plug member, two sliding sleeves and a cylinder body; the splitting line between the plug member and the cylinder body is set at different levels. Some of the tumblers must not be touched under normal operating conditions. In case a lock picker touches such special tumblers, such tumblers will be sprung out immediately, to trigger the warning assembly to send out a warning signal.

BREIF DESCRIPTION OF THE DRAWINGS

FIGS. 2 and 2-1 is a sectional view of the lock cylinder according to the present invention.

FIGS. 4-1 and 4-2 illustrate the lock cylinder and the warning assembly, being mounted in the body portion according to the present invention.

DETAILED DESCRIPTION

Figure 1:
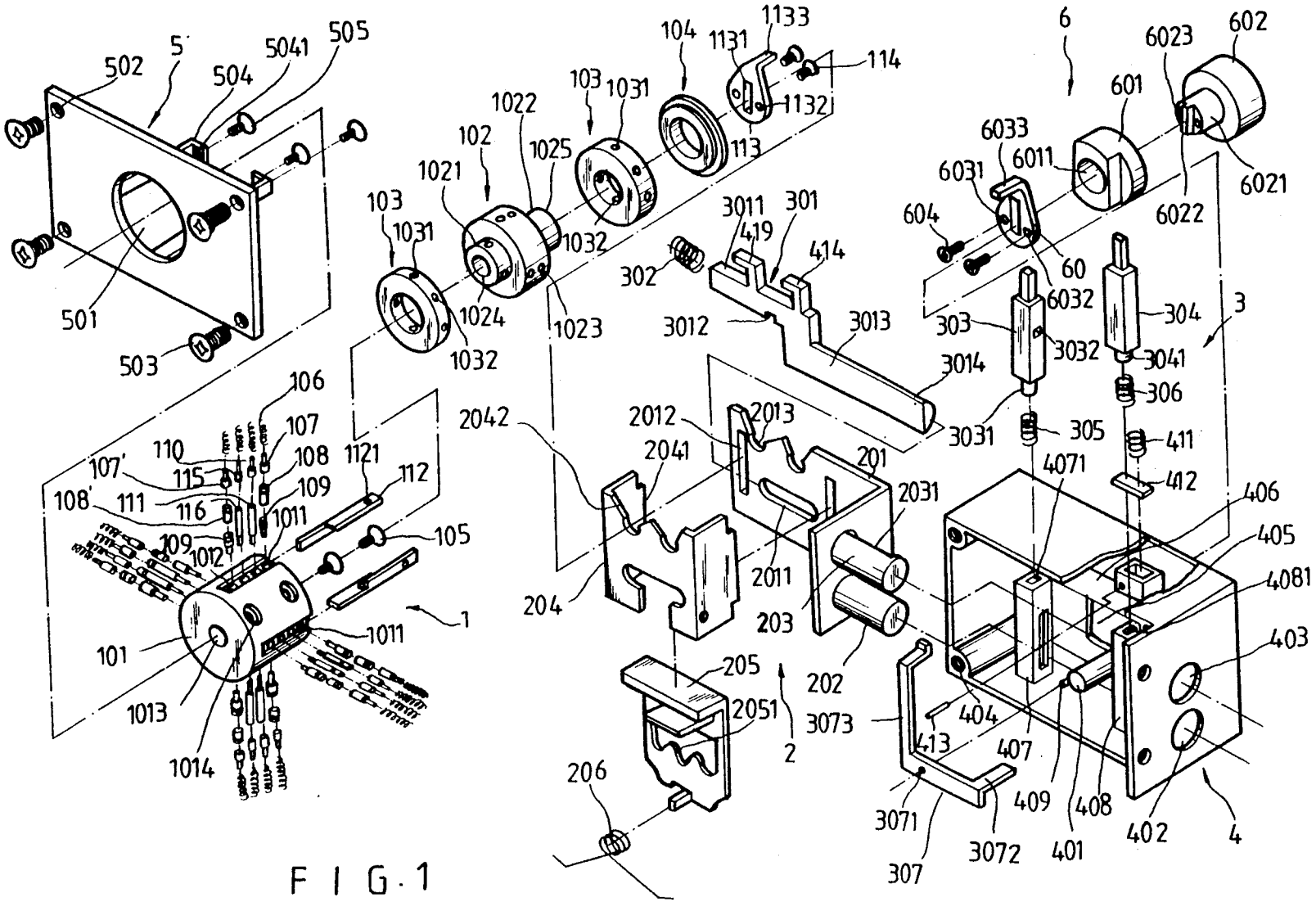
FIG. 1 is a perspective and disassembled view of an embodiment according to the present invention.
Figures 1, 2:
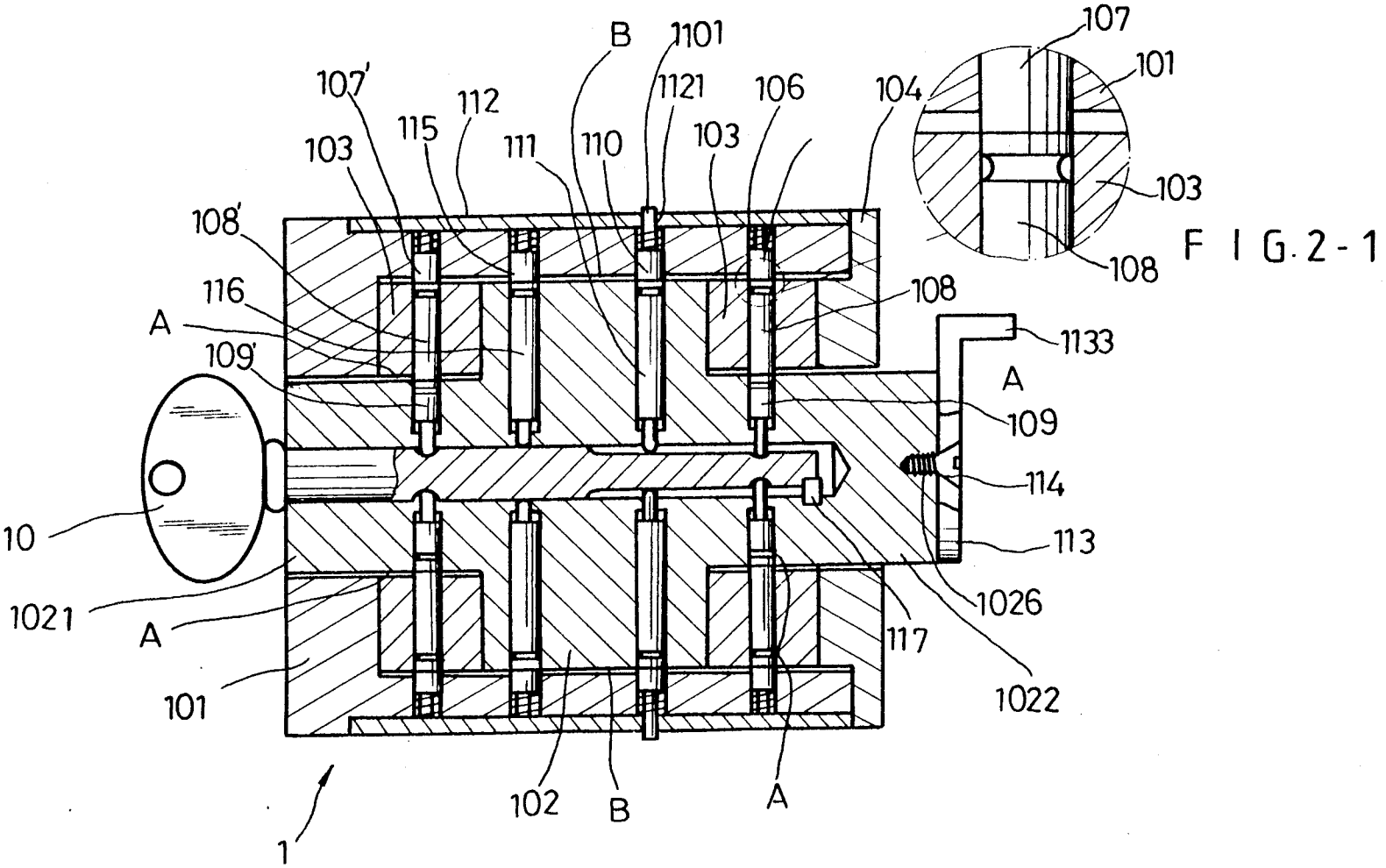
Figure 6:
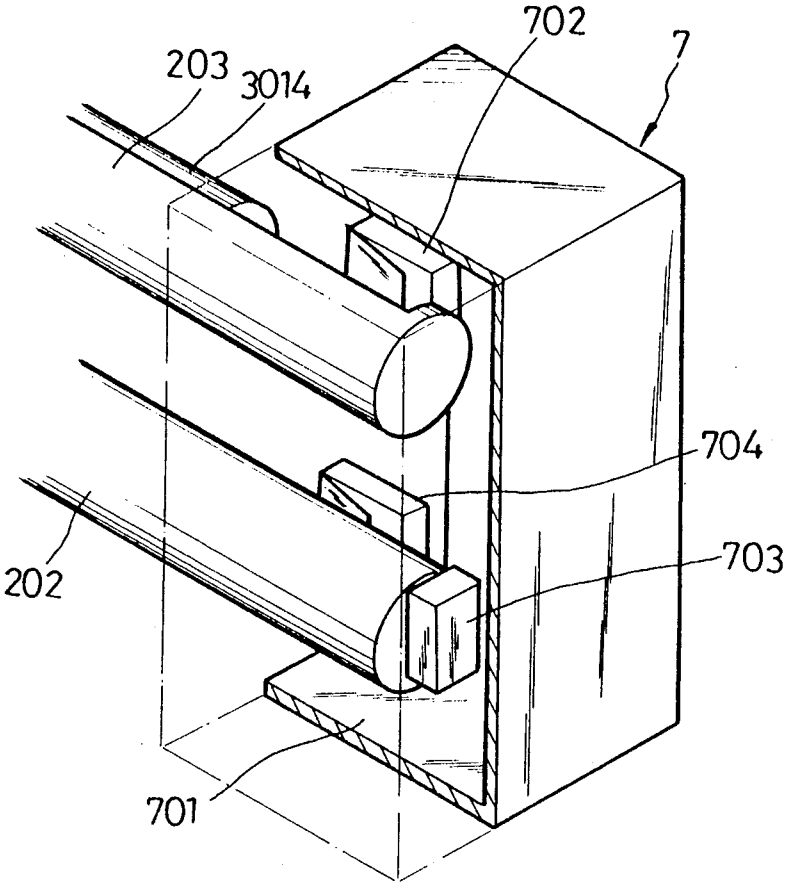
FIG. 6 is a perspective view of the inner parts of the latch plate according to the present invention.

FIG. 1 is a perspective and disassembled view of the present invention, which comprises a lock cylinder 1, a bolt coupling assembly 2, a warning assembly 3, a housing body portion 4, a cover plate 5, a knob 6, and a latch plate 7 (shown in FIGS. 1 and 6). In FIG. 2, the lock cylinder 1 includes a cylinder body 101 having a hollow core, and four grooves 1011 regularly arranged on four sides of the outer surface thereof; each of the grooves 1011 has four round holes 1012. The cylinder body 101 has a center hole 1013 on one end thereof for inserting a key; the cylinder body also has screw holes 1014 (FIG. 1) for receiving screws 105. As shown in FIG. 2 plug member 102 extends within cylinder body 101; the plug member includes two end portions 1021 and 1022 with smaller diameters, four round holes 1023 regularly arranged on four sides of the outer surface thereof, and an axial round hole 1024 with a salient block 117 at the bottom thereof. The end portion 1022 of plug member 102 has a square salient key 1025. Two sliding sleeves 103 encircle the end portions 1021 and 1022 of the plug member. Each sleeve has four round holes 1031 regularly arranged on four sides of the outer surface thereof; additionally each sleeve has a screw hole 1032 (FIG. 1). The two sliding sleeves 103 are mounted around the two end portions 1021 and 1022 respectively, and then the plug member is inserted in the cylinder body 101, being mounted in place with an end cap 104, which is attached to the rear end of the cylinder body 101. Screws 105 are fitted in the side holes 1014 of the cylinder body 101 and the screw hole 1032 of the sliding sleeves 103 respectively so as to fix the sliding sleeves 103 on both ends of the cylinder body 101. The springs 106, the upper tumblers 107, 115 and 110, the mid-tumblers 108, and the lower tumblers 109, 116 and end 111 are inserted in the round holes 1012, 1023 and 1031 of the cylinder body 101, the plug member 102 and the sliding sleeves 103 respectively; Simultaneously, each of the grooves 1011 on the cylinder body 101 receives a retaining strip 112; each retaining strip 112 has a round hole 1121 to facilitate the thin end 1101 of the upper tumbler 110 to be slightly projected out of the hole 1121, while the springs and tumblers are mounted and sealed in the lock cylinder. The salient key 1025 at rear end of the plug member 102 is to be mated with the slot 1131 of the eccentric cam rod 113; the eccentric cam rod 113 is fixedly attached to the plug member 102 with screws 114 through round holes 1132 (FIG. 1) and screw holes 1026 (FIG. 2). The cover plate 5 is a rectangular plate with a through hole 501 and four screw holes 502 in the four corners thereof. One side of the cover plate 5 has three L-shaped mounting arms 504 with screw holes 5041 to facilitate insertion of screws 505 through holes 5041 into screw holes (not shown) at the rear end of the end cap 104 so as to have the lock cylinder 1 fixedly attached to the cover plate 5.

Figure 3:
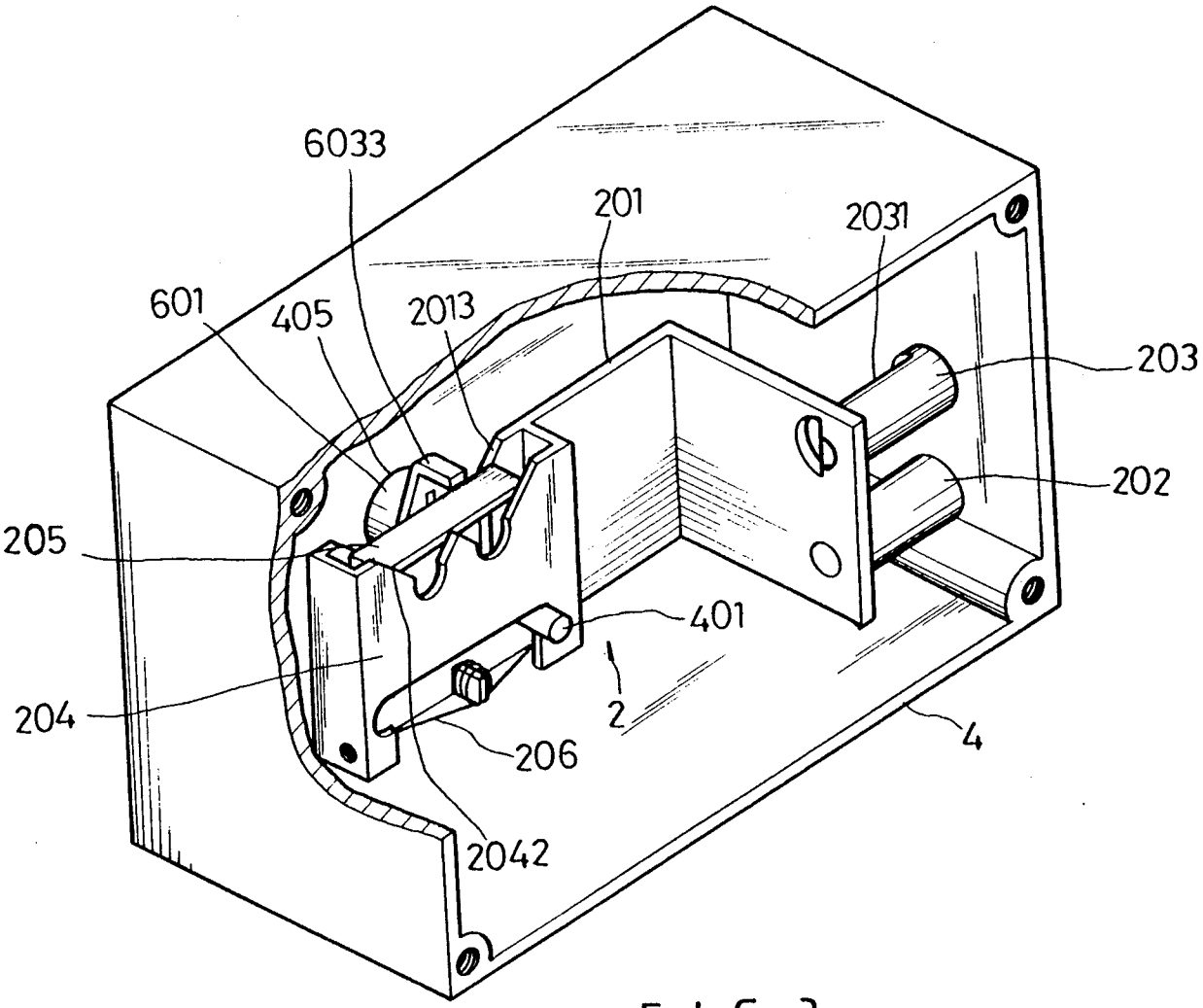
FIG. 3 is a perspective view of the bolt coupling assembly and the knob assembly according to the present invention.

The bolt coupling assembly 2 shown in FIGS. 1 and 3 includes a coupling plate 201 which has two lock bolts 202 and 203; the bolt 203 has a flat surface 2031 whereas bolt 202 is cylindrioal. The upper part of the coupling plate 201 has a W-shaped retaining surface 2013 and a liner slot 2011; the slot 2011 is to be engaged with a stud 401 on the housing body portion 4 so as to have the coupling plate 201 slide laterally along the body portion 4, and to have the two lock bolts 202 and 203 moved back and forth through two round holes 402 and 403 respectively. Two tenons 2041 of the cover 204 are to be mated with two slots 2012 in the coupling plate 201. A slidable plate 205 is mounted between the coupling plate 201 and the cover 204 for up and down; the sliding plate 205 can be slid upwards by means of a torsion spring 206 (as shown in FIG. 3) so as to limit the later movement of the coupling plate 201 upon the retaining notch 2051 being retained by the stud 401 of the body portion 4. When the sliding plate 205 is pushed downwards, the stud 401 will be disengaged from the retaining notch 2051 so as to let the coupling plate 201 and the lock bolts 202 and 203 move freely.

The housing body portion 4 has a hole 405 (FIG. 1), in which a sleeve member 601 is mounted; the sleeve member 601 has a through hole 6011, which is to be mounted on a stud 6021 of a knob 602; the front end of the stud 6021 has a square tenon 6022, which is to be mated with a rectangular slot 6031 in an eccentric cam rod 60, which is fixedly attached, with two screws 604 to pass through two screw holes 6031 and 6032, to the knob 602; the eccentric cam rod 60 will be moved sychronously with the knob 602. The arm 6033 on the eccentric cam rod is used for actuating the sliding plate 205 of the bolt coupling assembly 2 to move downwards, and to drive the "W"-shaped retaining surface 2013 of the coupling plate 201 so as to cause the coupling plate 201 to slide within housing body portion 4. After the knob 602 rotates the arm 6033 clockwise one turn to push the retaining surface 2013, the lock bolts 202 and 203 will be moved out one step. The lock bolts 202 and 203 will be moved out a second step upon the arm 6033 being rotated another turn clockwise. If the arm 6033 is rotated counter-clockwise, the lock bolts 202 and 203 will retract backwards into housing body portion 4 (Since the bolt coupling assembly 2 is a well-known device and not a feature claimed in the claims, no further details thereof are given.)

In the four corners of the body portion 4, there are four screw holes 404 for receiving four screws 503 to pass through four screw holes 502 respectively so as to attach the cover plate 5 to the housing body portion 4.

Figures 1, 4:
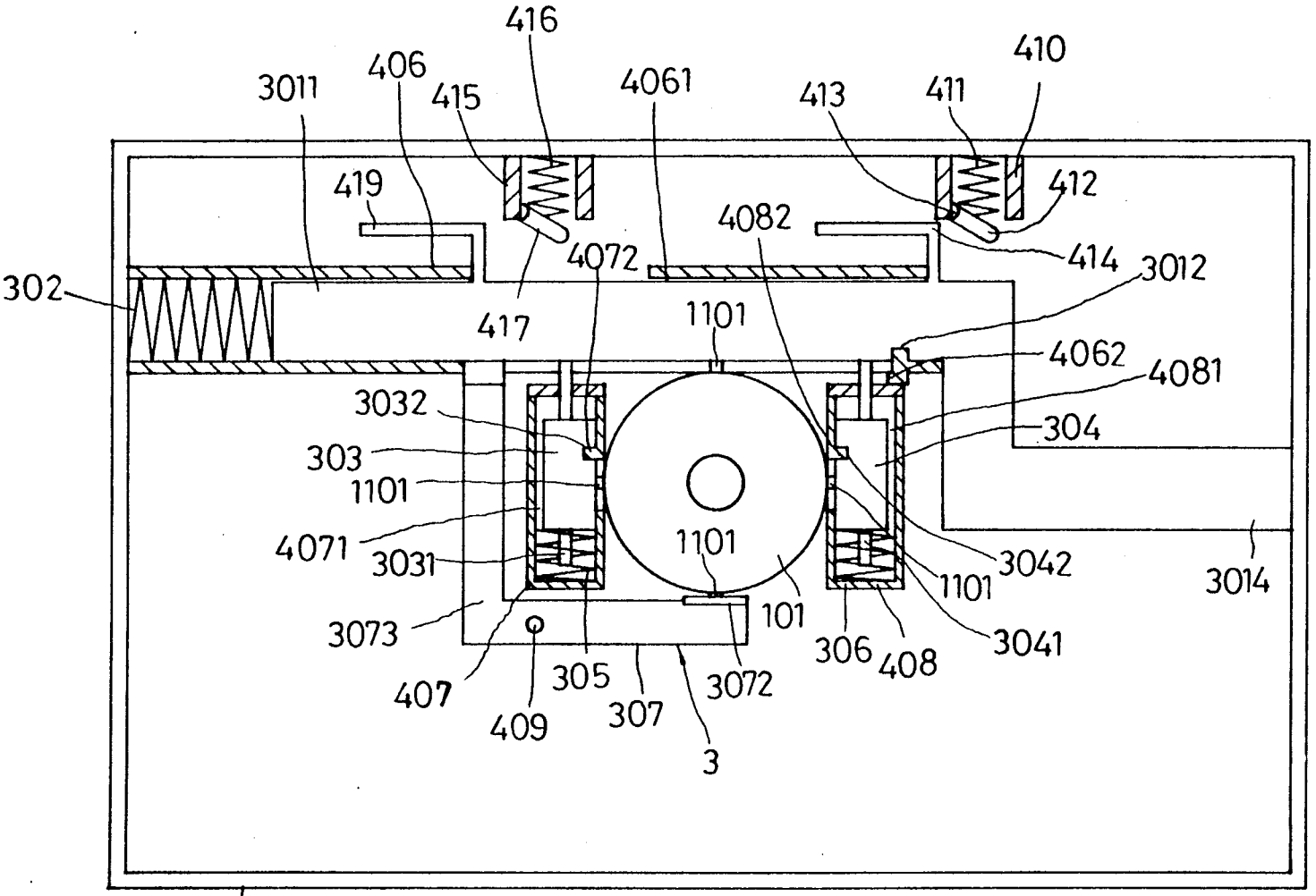
Figures 2, 4:
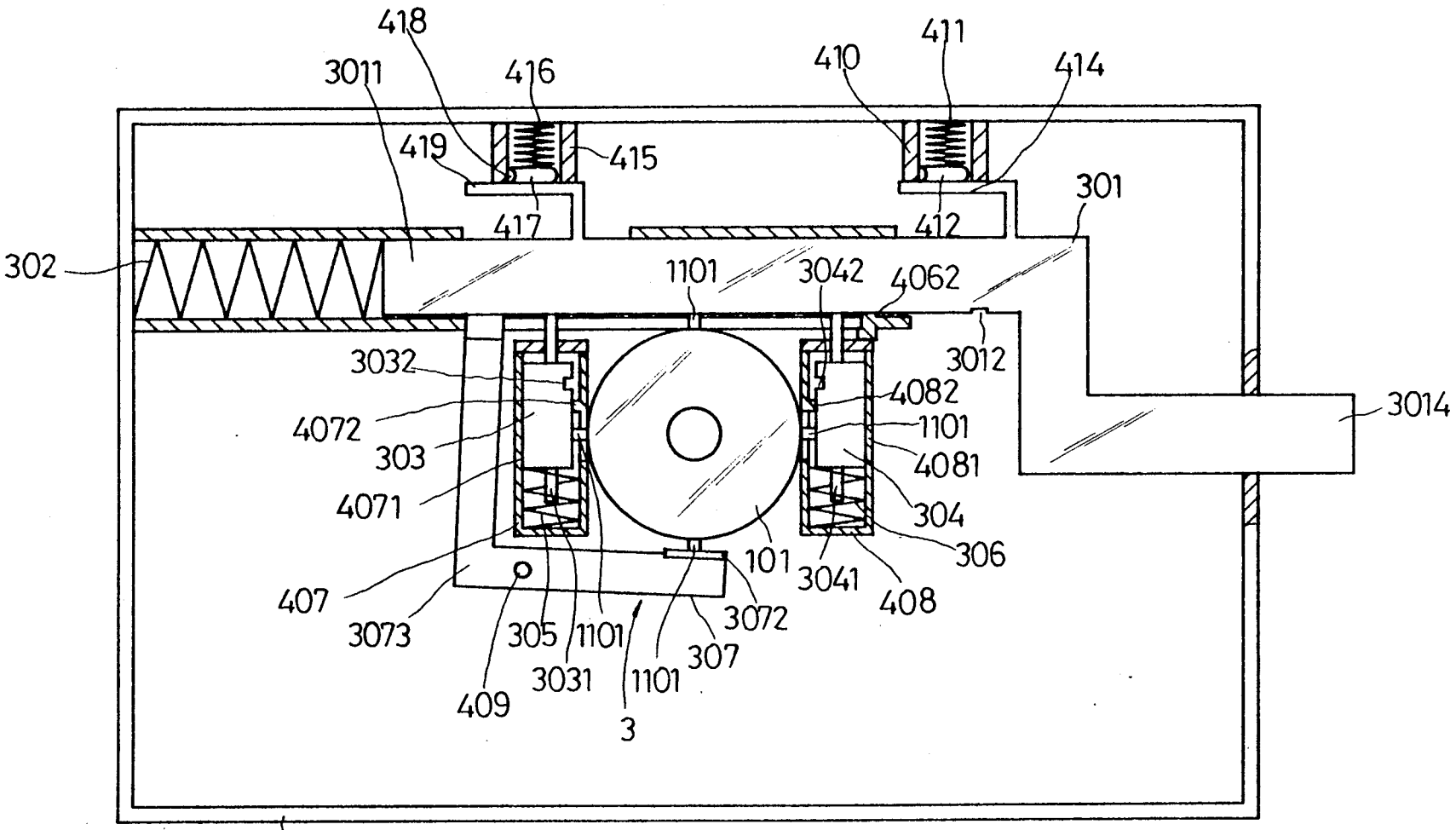

FIGS. 4-1 and 4-2 illustrate a sectional view of the inner part of the body portion and the warning assembly 3. In the housing body portion 4, there is a hollow horizontal arm 406 with a sliding slot 4061 for mounting a sliding portion 3011 of a switch control rod 301 therein. The rear end of the sliding portion 3011 is loaded with a spring 302 which acts to bias the switch control rod 301 rightwards; however, the switch control rod 301 is normally held in the position of FIG. 4-1 by a salient block 4062 loaded with a spring 420 (FIG. 5) Block 4062 projects into a groove 3012 in the rod 301. In the body portion 4, there are two vertical hollow guide members 407 and 408 that form guide surfaces 4071 and 4081 therein respectively for two slidable rods 303 and 304 studs 3031 and 3041 project from rods 303 and 304 into springs 305 and 306 respectively so that the slidable rods 303 and 304 are normally pushed to the positions shown in FIG. 4-1. The vertical members 407 and 408 have lugs 4072 and 4082 loaded with springs (not shown) respectively, which are the same in structure and function as the springs and salient block 4062 shown in FIG. 5. Lugs 4072 and 4082 project into slots 3032 and 3042 in the slidable rods 303 and 304 respectively; therefore, the slidable rods 303 and 304 are prevented from moving upwards by the pushing force of springs 305 and 306. The body portion 4 has a small pin 409 that extends through a round hole 3071 in an L-shaped coupling lever 307 whereby the lever can pivot around the pin 409 axis. The horizontal arm 406, the vertical members 407 and 408, and the coupling lever 307 are all mounted around the cylinder body 101 of the lock cylinder 1 (as shown in FIGS. 4-1 and 4-2). Above horizontal arm 406 in housing body portion 4, there are two spring sockets 410 and 415 containing coil springs 411 and 416 respectively. The upper ends of the springs 411 and 416 are set against the body portion 4, while the lower ends of the springs are attached to two valves 412 and 417 respectively. One end of each valves is movably attached to an inner end of an associated spring socket 410 or 415 with pivot pins 413 and 418 respectively. The lower ends of the spring sockets have openings 4101 and 4151 respectively, adapted to align with two slidable plates 414 and 419 carried on the switch control rod 301, as shown in FIG. 4-2.

Referring to FIG. 2, properly a configured key 10 is inserted into the round hole of the plug member 102 in the lock cylinder 1 to have a slot in the front end of the key engaged with a salient block 117. The key 10 will push the various lower tumblers 109, 111 and 116 in the plug member 102 upwards to cause all the mid-tumblers 108, and all the upper tumblers 107, 110 and 115 to move up to two splitting lines A and B between the end portions 1021, 1022 of the plug member 102 and the sliding sleeves 103, and between the mid-part of the plug member 102 and the cylinder body 101; in that case, the plug member 102 can be turned freely; and the eccentric cam rod 113 attached to the rear end of the plug member 102 will also be rotated synchronously to push a sliding plate 205 of the bolt coupling assembly 2 downwards so as to have a stud 401 in the body portion 4 disengaged from a retaining notch 2051; at the same time, the pressing surface 2042 on the cover 204 will be driven to actuate the coupling plate and the lock bolts 202 and 203 to move back and forth through the round holes 402 and 403 of the body portion 4 and also through the corresponding mortises in the latch plate 7 on a door jamb (as shown in FIG. 6). According to the present invention, each of the four sides of the plug member 102 in the cylinder body 101 has one set of false tumblers 110 and 111. In case the person inerts a wrong improperly configured key in the lock, the upper tumbler will be touched; the lower tumblers 111 will push the upper tumbler 110 through a hole 1121 in the retaining strip 112 to cause the thin end 1101 thereof out of the retaining strip 112 (as shown in FIG. 4-2); then, the thin end 1101 will push the switch control rod 301 in the horizontal arm 406 upwards, and the switch control rod 301 will be disengaged from the salient block 4062, and pushed to the right by spring 302. One side of the switch control rod 301 has a flat surface 3013 (FIG. 2) in close contact with the flat surface 2031 of the lock bolt 203. When the switch control rod is sliding out, the touch-off end 3014 of the switch control rod will trigger a micro-switch 702 (FIG. 6) in the mortise 701 of the latch plate 7; the micro-switch 702 is electrically connected with a warning device, which can send out a warning signal or notify the owner. Simultaneously, another micro-switch 703 is mounted in the mortise 701 of the latch plate 7, and when the lock bolts 202 and 203 are set in locked-up condition, the micro-switch 703 will be turned on to set the warning device in stand-by condition. Whenever a thief touches the warning assembly 3, the switch control rod 301 will be sprung out to trigger the micro-switch 702 to generate a warning signal.

Referring to FIG. 4-2 again, if the false tumblers 110 and 111 mounted on the left or right side of the plug number 102 and the cylinder body 101 are touched un-intentionally, the thin end 1101 of the upper tumbler 110 will push against the slidable rod 303 or 304 in the vertical member 407 or 408 to disengage the rod from the lug 4072 or 4082, and the slidable rod 303 or 304 will be pushed, by spring 305 or 306, upwards to cause the switch control rod to be lifted and moved to the right to trigger the warning device.

Figure 5:
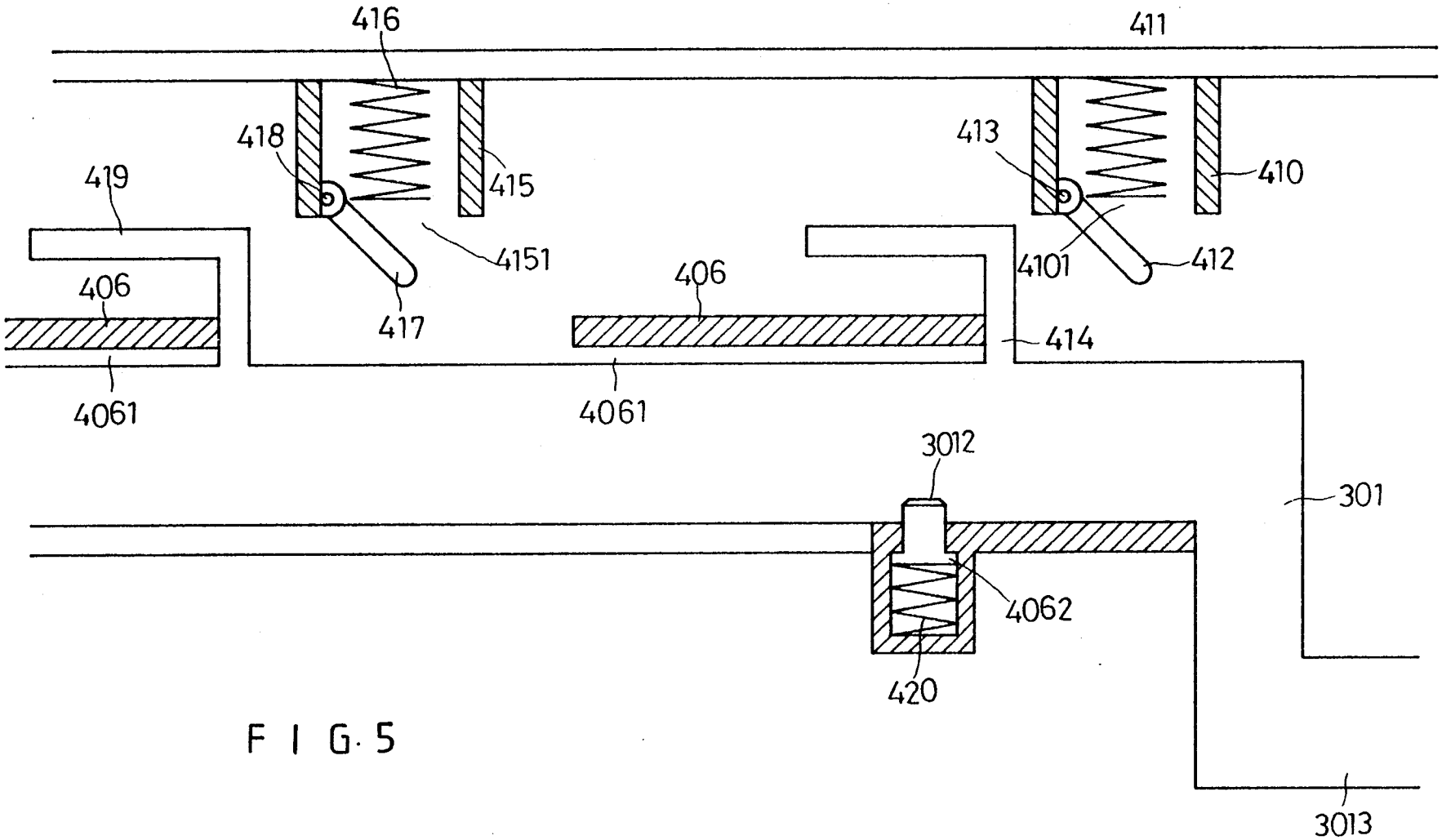
FIG. 5 is an enlarged view of the relative position of the spring base and the slidable plates on top of the switch control rod according to the present invention.

Further, the top side of the switch control rod 301 has a slidable plates 414 and 419 which move synchronously with the switch control rod; when the rod 301 springs rightwards, the slidable plates 414 and 419 will be moved into alignment with the openings 4101 and 4151 of the spring sockets 410 and 415 to cause the springs 411 and 416 to push against the valves 412 and 417 to press downwards respectively, i.e., pressing against the top side of the switch control rod 301. In order to have the groove 3012 engaged with a salient block 4062 the horizontal guide arm 406 for the switch control rod 301 moves backwards with the lock bolt 203. When the switch control rod 301 moves backwards, the slidable plates 414 and 419 will release the pushing force of the spring 411 and 416 in the spring sockets (as shown in FIG. 5) i.e., the force pressing against the switch control rod 301 will be removed. Although the switch control rod 301 is pushed by the slidable rods 303 and 304, the switch control rod 301 can press the slidable rods 303 and 304 downwards to their original position as a result of the springs 411 and 416 having higher force than that of springs 305 and 306; then, the slidable rods 303 and 304 are retained in place by the lugs 4072 and 4082 respectively. In that case, the switch control rod 301 and the slidable rods 303 and 304 are returned to their original position respectively, being retained by the salient block 4062 and the lugs 4072 and 4082 respectively. The valves 412 and 417 are also disengaged from the slidable plate 414 and 419 respectively; the spring 411 and 416 then exert no force against the switch control rod 301. In that case, the springs 305 and 306 are loaded with a higher force to lift the switch control rod 301 upward as soon as the slidable rods 303 and 304 are released next; the force of springs 411 and 416 would not hinder the switch control rod 301 to be lifted up. The fulcrum of the coupling lever 307 is the small pin 409; whenever the upper and lower tumblers 110 and 111 installed at the lower side of the plug member 102 and the cylinder body 101 are un-intentionally touched, the thin end 1101 of the upper tumbler 110 will push the right end 3072 of the coupling lever 307 downwards, while the left end 3073 of the lever 307 is moved upwards to push the switch control rod 301 to trigger the warning device. When the thin end 1101 is retracted back, the left end 3073 will move downwards to its original position. In brief, no matter how a thief touches unintentionally any one of the tumblers on the four sides of the cylinder body 101 and the plug member 102, the switch control rod 301 will be sprung out to trigger the warning device. If a thief should hit and push the door to cause the lock bolt 202 to move inwards, the micro-switch 704 will be turned on (as shown in FIG. 6) to trigger the warning device. It is deemed that the present invention can provide an excellent burglar alarm function.

I claim:

1. A lock structure comprising a lock housing (4), a hollow lock cylinder mounted in said housing; a rotary plug member within said cylinder, said plug member having an axial keyhole slot therein; a plural number of aligned lock actuator tumblers extending within the plug member and the cylinder whereby insertion of a properly configured key into the keyhole slot causes the plug member tumblers to push the cylinder tumblers outwardly to positions wherein the plug member can be rotated; lock bolt means movable between a locking position and an unlocking position; means (2) for coupling the plug member to the lock bolt means, whereby rotation of the plug member moves the lock bolt means to its unlocking position; aligned false tumblers (111,110) extending within the plug member and the cylinder, whereby insertion of an improperly configured key into the keyhole slot causes the false tumblers in the plug member to push the associated cylinder false tumblers outwardly to a position projecting from the cylinder; a warning switch means (702); and an actuator means (301) for said switch means; said actuator means being operatively connected to said false tumblers so that when a cylinder false tumbler is forced outwardly to a position projecting from the cylinder the actuator means is operated to actuate the warning switch means.

2. The lock structure of claim 1, and further comprising a fixed latch means (7) separate from the lock housing, said latch means being in registry with said lock bolt means to retain the lock structure in a locked condition; said warning switch means being mounted in said fixed latch means; said actuator means comprising a rod movably mounted within the lock housing for motion with respect to the fixed latch means to actuate the warning switch means.

3. The lock structure of claim 2, and further comprising reset means (203,406) movable with the lock bolt means for moving said rod away from the fixed latch means when the lock bolt means is operated to its unlocking position disengaged from said latch means.

4. The lock structure of claim 3, and further comprising spring means (302) for rapidly moving said rod into the fixed latch means in response to a triggering force on the rod by a false tumbler of the lock cylinder.

* * * * *